United States Patent [19]

Gross

[11] 4,180,956

[45] Jan. 1, 1980

[54] WALL TIE AND A WALL INCORPORATING THE WALL TIE

[76] Inventor: Fernand Gross, 23 rue de Molsheim, Strasbourg (Bas-Rhin), France

[21] Appl. No.: 891,396

[22] Filed: Mar. 28, 1978

[30] Foreign Application Priority Data

Apr. 6, 1977 [FR] France ..... 77 12486

[51] Int. Cl.[2] ..... E04B 2/00

[52] U.S. Cl. ..... 52/407; 52/563

[58] Field of Search ..... 52/407, 562, 563, 586, 52/426, 712, 405, 404, 569, 570, 564, 565, 275

[56] References Cited

U.S. PATENT DOCUMENTS

| | | | |
|---|---|---|---|
| 2,048,901 | 7/1936 | Vale | 52/564 X |
| 2,213,355 | 9/1940 | Woodworth | 52/562 X |
| 3,304,677 | 2/1967 | Paulecka | 52/586 X |
| 3,902,296 | 9/1975 | Thomas | 52/426 X |

FOREIGN PATENT DOCUMENTS

| | | | |
|---|---|---|---|
| 2202994 | 5/1974 | France . | |
| 74118 | 10/1948 | Norway | 52/562 |

*Primary Examiner*—Carl D. Friedman

*Attorney, Agent, or Firm*—Young & Thompson

[57] ABSTRACT

The disclosure is of a wall tie for tying together spaced panel units on opposite sides of a wall, the wall tie comprising two elongated extremities to engage in guide grooves in the respective panel units, the said extremities being interconnected by web portions having serrated edges and adapted to fit into complementary recesses in insulating elements and so maintain these elements in position inside the wall against both vertical and horizontal displacement.

2 Claims, 2 Drawing Figures

WALL TIE AND A WALL INCORPORATING THE WALL TIE

INTRODUCTION AND BACKGROUND OF THE INVENTION

This invention relates to a wall structure incorporating a wall tie. The wall structure may be a cavity wall structure of the kind (herein called "the kind defined") comprising panel units disposed in two parallel vertical planes, the panel units in one of said planes being connected by ties to the panel units in the other of said planes.

It has been proposed to provide a wall structure of the kind defined which has hollow panel units and in which the ties comprise web portions with extremities which are wider in cross-section than the web portions and each of these extremities comprises two projections parallel to and remote from the web portions, and the panel units have grooves in their vertical edges, each of the grooves being complementary in cross-sectional shape to and able to receive one half of one of the said extremities so that thereby the panel units are locked in position relative to one another.

The present invention is intended to facilitate the provision of insulation within a wall structure of the kind defined.

Another object of the invention is to provide a wall incorporating a wall tie which is simple and yet can save time and serve effectively to hold insulating blocks in place inside a cavity wall, and which greatly facilitates the erection of such a wall.

Further objects and advantages of the invention appear from the following description and the accompanying drawing.

BRIEF SUMMARY OF THE INVENTION

According to the present invention there is provided a wall incorporating a wall tie comprising two elongated extremities and two web portions which interconnect said extremities and have serrated edges.

Preferably the wall tie comprises two elongated extremities spaced apart from and parallel to each other, and two web portions which are spaced apart from and parallel to each other and interconnect the said two extremities and have serrated edges.

FURTHER DESCRIPTION AND ADVANTAGES OF THE INVENTION

The invention also includes a cavity wall structure of the kind defined herein, in which the ties comprise web portions with extremities which are wider in cross-section than the web portions and each of these extremities comprises two projections parallel to and remote from the web portions, and the panel units have grooves in their vertical edges, each of the grooves being complementary in cross-sectional shape to and able to receive one half of one of the said extremities so that thereby the panel units are locked in position relative to one another, characterised in that the web portions of the ties have serrated edges and fit into complementary recesses in insulating elements and maintain the insulating elements in position inside the cavity of the wall structure against both vertical and horizontal displacement.

How the invention may be put into practice appears from the following description with reference to the accompanying schematic drawing.

BRIEF DESCRIPTION OF THE VIEWS IN THE DRAWING

In the said drawing:

FIG. 1 is a sectional plan view of parts of a structure in accordance with the invention, and FIG. 2 is a partially perspective detail view showing insulating elements interconnected by a tie.

DETAILED DESCRIPTION OF THE PREFERRED EMBODIMENT

Figure 1:
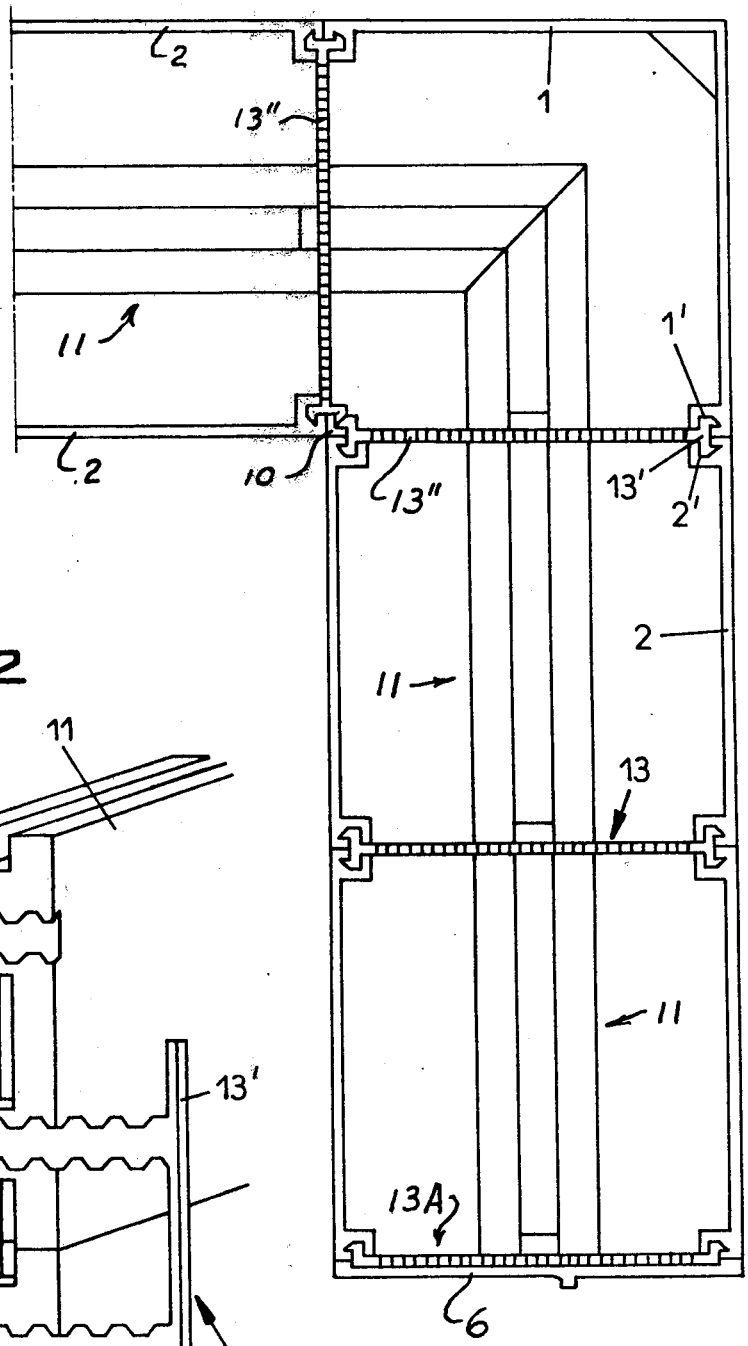

In the drawings are shown parts of a structure of the kind defined, a comprising panel units 2 disposed in two parallel vertical planes, the panel units 2 in one of said planes being connected by ties 13 to the panel units 2 in the other of said planes, and also the corner units 1.

Each of the ties 13 comprises two parallel web portions 13″ spaced from each other and connected together by elongated extremities 13′ which are parallel to each other and are wider in cross-section (as viewed in FIG. 1) than the web portions 13″. Each of these extremities 13′ comprises two projections parallel to and remote from the web portions 13″.

The panel units 2 have grooves 2′ in their vertical edge channel parts, each of the grooves 2′ being complementary in cross-sectional shape to and able to receive one half of one of the extremities 13′ so that thereby the panel units 2 are locked in position relative to one another, as is shown more particularly in FIG. 1.

Figure 2:
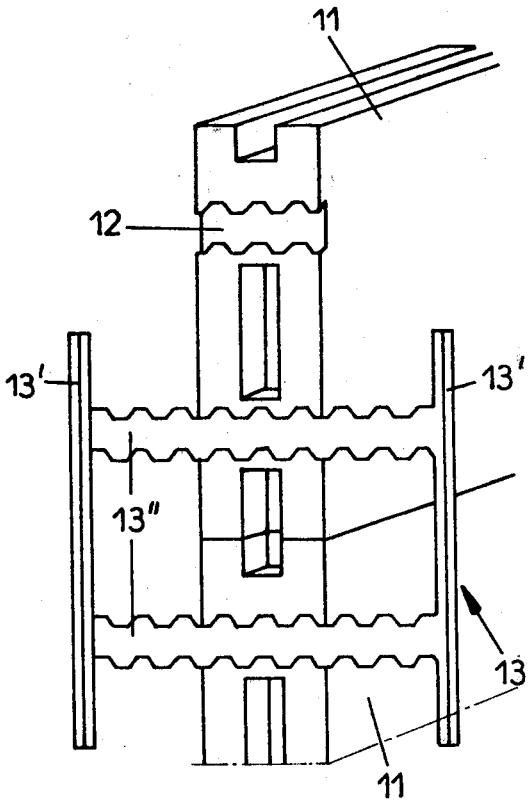

Each of the ties 13 has a central aperture between its two web portions 13″, as shown in FIG. 2.

FIG. 1 also shows one of the right-angled corner units 1 with edge channel parts having grooves 1′ complementary to the panel units 2 and tie extremities 13′, whereby the units 1 and 2 are locked in position relative to one another. There are locking strips 10 each engaging two of the tie extremities 13′ where these are adjacent to each other at a corner formed by panel units 2 at right-angles to each other, and thereby the respective ties and panel units are secured together.

Also provided are lateral closure elements 6 and modified ties 13A for use at places where the structure terminates, for example at a window or door frame or at the end of a wall. The elements 6 may have cross-sectional profiles to suit a window or door frame to be attached thereto. The modified ties 13A have projections for engaging in the grooves 2′ of the respective panel units 2 and are secured to the elements 6 to hold the latter in position.

As the drawings show, the web portions 13″ of the ties 13 have serrated edges and fit into complementary recesses 12 in insulating elements 11, and maintain the insulating elements 11 in any desired position inside the cavity of the wall structure against both vertical and horizontal displacement.

The illustrated elements 11 are in the form of substantially rectangular slabs or blocks with channels in their horizontal edge surfaces and slots in their vertical edge surfaces, which are also provided with the recesses 12. The elements 11 as shown fit together to provide a continuous imperforate barrier, and they may be of foamed concrete or any other suitable material and may engage one another with tongue-and-groove or other formations, and may be for the purposes of impeding the transmission of heat and/or noise and/or moisture and/or the passage of vermin or odours.

The web portions 13″ may be given serrations of sinewave or saw-tooth or any other suitable form and various other modifications may be introduced within the scope of the following claims.

What is claimed is:

1. A wall comprising in combination a plurality of panel units disposed in two parallel vertical planes and edgewise abutting each other in each plane in vertical joints, a plurality of insulating elements disposed between said panel units and edgewise abutting each other in a vertical plane common to said joints, there being a plurality of said insulating elements disposed one atop the other, said panel units having grooves adjacent said joints, and at least one wall tie having two vertical elongated extremities each to which has two web portions that are spaced apart and parallel to each other and interfit in said grooves to hold abutting said panel units together, one of said extremities holding together the panel units in one of said two parallel vertical planes and the other of said elongated extremities holding together the panel units in the other of said two parallel vertical planes, and two vertically spaced serrated web portions extending between and interconnecting said elongated extremities of said wall tie, one of said serrated web portions fitting into a recess complementary in shape in an edge of one said insulating element and the other said serrated web portion fitting into a recess complementary in shape in another said insulating element which is in vertical alignment and edgewise abutment with said one insulating element, whereby said two serrated web portions hold said one and another insulating elements in vertical alignment and abutting relationship against vertical and horizontal movement relative to each other and relative to said panel units.

2. A wall as claimed in claim 1, there being a plurality of said insulating elements disposed in different planes that are parallel to each other and to said panel units and that are maintained in said different planes by said serrated web portions.

* * * * *